United States Patent [19]

David

[11] Patent Number: 4,484,533

[45] Date of Patent: Nov. 27, 1984

[54] METHOD AND APPARATUS FOR TRANSPORTING POTABLE WATER AND OTHER FLUIDS

[76] Inventor: George J. David, 3076 Fairmount Blvd., Cleveland Heights, Ohio 44118

[21] Appl. No.: 310,457

[22] Filed: Oct. 13, 1981

[51] Int. Cl.[3] ..... B63B 25/08

[52] U.S. Cl. ..... 114/74 R; 220/85 B

[58] Field of Search ..... 114/74 R, 74 A, 74 T, 114/125, 65 R, 72, 256; 220/85 B, 85 A; 137/572–576

[56] References Cited

U.S. PATENT DOCUMENTS

| | | | |
|---|---|---|---|
| 2,696,185 | 12/1954 | Snoddy | 114/74 R |
| 2,758,747 | 8/1956 | Stevens | 220/85 B |
| 3,658,080 | 4/1972 | Mitchell | 220/85 B |
| 3,943,873 | 3/1976 | Hering et al. | 114/74 R |
| 4,347,798 | 9/1982 | Gallagher | 114/74 R |

FOREIGN PATENT DOCUMENTS

| | | | |
|---|---|---|---|
| 2109978 | 9/1972 | Fed. Rep. of Germany | 114/74 R |
| 2017011 | 9/1979 | United Kingdom | 114/74 R |

OTHER PUBLICATIONS

LeMonde, Apr. 27, 1983, p. 15, *Fresh Water Tankers.*

LeMonde, May 25, 1983, p. 43, *Supplying the Persian Gulf with Fresh Water.*

*Primary Examiner*—Trygve M. Blix

*Assistant Examiner*—Stephen P. Avila

*Attorney, Agent, or Firm*—David A. Burge

[57] ABSTRACT

A non-permeable liner is utilized to define a first liquid-fillable chamber within a vessel, and cooperates with walls of the vessel to define a second liquid-fillable chamber external to the liner. Separate quantities of liquids are simultaneously transported in these separate chambers. In one application, a liner is utilized to segregate central portions of an oil tanker hold from surrounding portions thereof to provide a central chamber within which potable water can be transported. The liner cooperates with walls of the hold to define a surrounding chamber within which another liquid such as non-potable water can be shipped. In preferred practice the liner is formed from flexible, collapsible, relatively light-weight material which can be installed easily in a vessel such as an oil tanker hold, and which can be collapsed inside the vessel when the vessel is used for transporting a single quantity of liquid such as oil.

7 Claims, 3 Drawing Figures

METHOD AND APPARATUS FOR TRANSPORTING POTABLE WATER AND OTHER FLUIDS

BACKGROUND OF THE INVENTION

1. Field of the Invention

The present invention relates to a system for simultaneously transporting two separate quantities of liquid in a common vessel. One aspect of the invention lies in the use of a non-permeable liner (1) to define a first liquid-fillable chamber within a vessel, and (2) to cooperate with walls of the vessel to define a second liquid-fillable chamber which is exterior to the liner.

The system of the present invention can be used for transporting potable water in a hold of an oil tanker by using a non-permeable liner (1) to define a central chamber within the hold wherein a quantity of potable water can be transported, and (2) to cooperate with walls of the hold to define a surrounding chamber wherein another quantity of liquid can be transported.

2. Prior Art

In present day practice, oil tanker ships travel long distances across oceans to transport oil from oil-producing nations to oil-consuming nations. Despite the fact that many oil-producing nations characteristically have a very arid environment, oil tankers are not utilized to transport potable water to these nations during their return trips; rather, the empty holds of these ships are typically flooded with salt water for ballast.

When the salt water is flushed from the oil-coated holds it is polluted and is deemed too costly to recycle. Consequently, it has become common practice for tankers to dump oil-polluted salt water at sea, and this dumping is responsible for a significant percentage of today's salt water pollution.

While efforts have been made to transport fresh water in oil tanks, no economical means has been found by which the water can be treated following exposure to the oil-coated inner surfaces of an oil tanker hold to remove pollutants therefrom to a sufficient degree to render the water potable.

SUMMARY OF THE INVENTION

The present invention overcomes the need to flood the empty holds of an oil tanker with salt water for ballast, and provides a means by which the holds of an oil tanker can be used to transport valuable quantities of potable water.

In one aspect, the system of the present invention provides a means by which two separate quantities of a wide variety of liquids can be simultaneously transported in a common vessel. However, the system of the present invention is particularly attractive for use with oil tankers to render productive their customarily unproductive return trips to an oil-producing country by transporting potable water in their holds.

In accordance with the preferred practice of the present invention, a liquid-fillable vessel, such as a hold of an oil tanker ship, is provided with a non-permeable liner which serves the dual purposes of (1) defining a first liquid-fillable chamber within the vessel, and (2) cooperating with walls of the vessel to define a second liquid-fillable chamber which is external to the liner. If the chamber which is interior to the liner is filled with potable water, the liner prevents the potable water from coming into contact with the oil-coated inner surfaces of the hold, and thereby keeps the potable water from becoming polluted with oil from the hold. If the chamber which is exterior to the liner is filled with fresh water, the fresh water will become polluted with oil from the hold, but techniques are known for treating such water sufficiently economically to enable it to be used for certain agricultural and other purposes.

One problem with providing a liner for an oil tanker hold is that a substantial amount of bracing and other bulwark is present within the hold. The sides of a tanker hold are not smooth but rather incorporate plates, beams and other bracing which typically extends into the hold for a distance of several feet. Providing a liner which will conform to the highly complex shapes of the bulwark within a hold is impractical.

Still another factor to be addressed is that, if a liquid is to be transported in the hold of a tanker, it is necessary, in order to maintain the ship's stability, that the hold be filled completely from side-to-side and from end-to-end so that the liquid cannot suddenly shift position and impact one of the walls of the hold.

The approach taken by the present invention permits the use of a relatively simply configured liner within the complexly configured hold of a tanker while, at the same time, assuring that the hold is fully filled from side-to-side and end-to-end. The liner defines an inner chamber for holding a first quantity of liquid such as potable water, and cooperates with the walls of the hold to define an outer, surrounding chamber wherein a second quantity of liquid such as fresh water can be transported. The inner and outer chambers are filled and unloaded in a controlled manner so that the level of the liquids in both chambers is maintained substantially equal. The liner is formed from a flexible material which enables its shape to vary during filling and unloading to assure that the liquid levels in both chambers remain equal. The liner not only preserves the purity of the liquid contained in its inner chamber but also utilizes the liquid in the outer chamber as a cushion to assist in preserving liner integrity. By utilizing a liner to divide a tanker hold into inner and outer chambers, the liner need not conform to the complex shape of a hold and can be quite simply configured.

By providing a system which enables the holds of a tanker ship to be productively utilized during return trips of the ship to an oil-producing country, the need for the pollution-generating practice of flooding the holds with salt water for ballast is eliminated.

These and other features and a fuller understanding of the present invention may be had by referring to the following detailed description and claims taken in conjunction with the accompanying drawing.

DESCRIPTION OF THE PREFERRED EMBODIMENT

Figure 1:
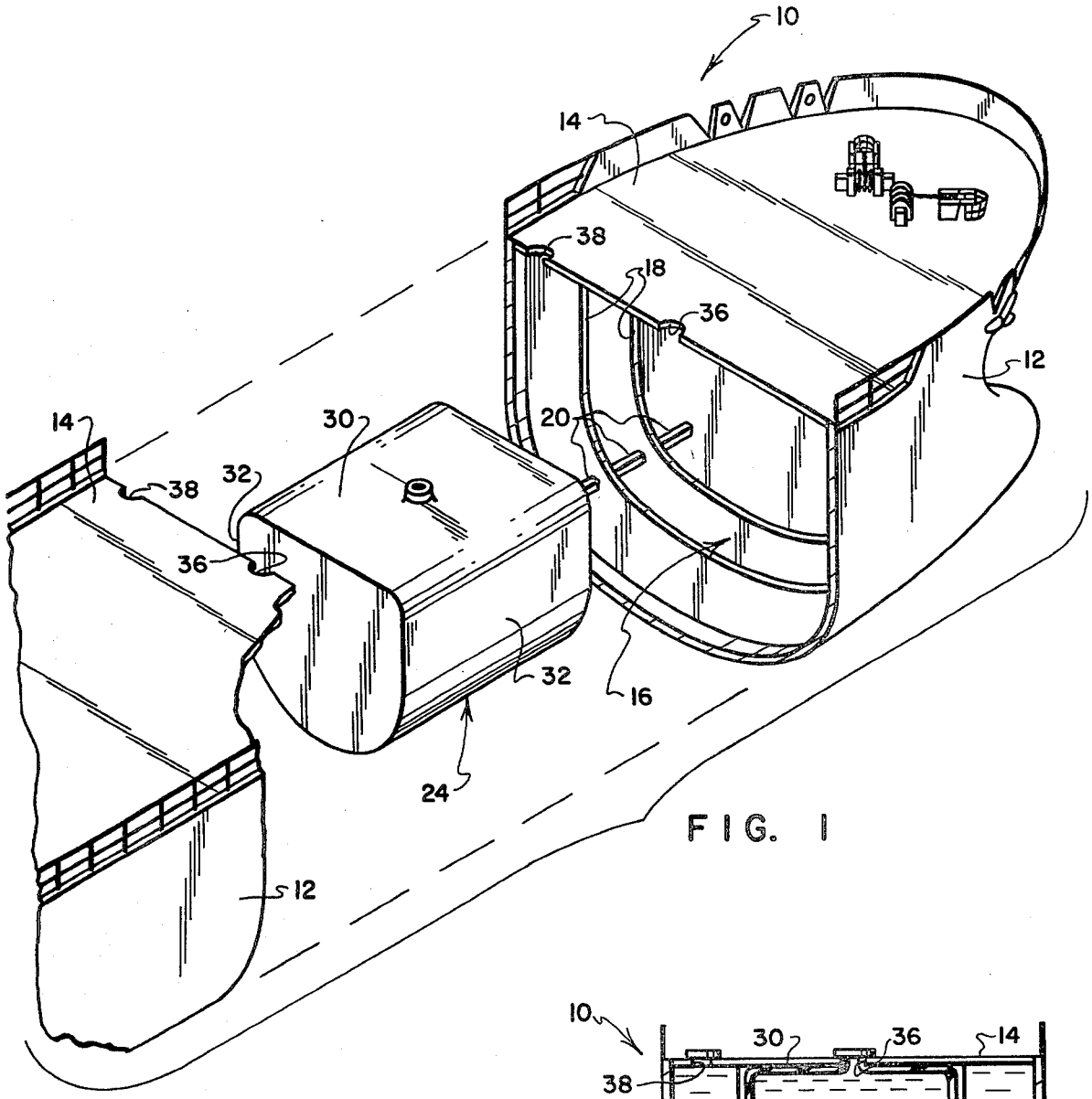
FIG. 1 is an exploded perspective view of portions of a tanker ship showing interior portions of a hold provided therein, and showing a liner for insertion into the hold.

Referring to FIG. 1, a tanker ship is indicated generally by the numeral 10. The ship 10 includes hull and deck structures 12, 14 which cooperate to define a series of holds below deck, one of the holds being indicated generally by the numeral 16.

A system of plate members 18 and bracing members 20 is provided within the hold 16 for stiffening and rigidifying the hull and deck structures 12, 14. The plate members 18 extend inwardly into the hold 16 for distances of only a few feet at locations along peripheral portions of the hold 16, whereby a relatively large central region of the hold 16 is left unobstructed. The bracing members 20 extend between adjacent ones of the plate members 18.

Figure 2:
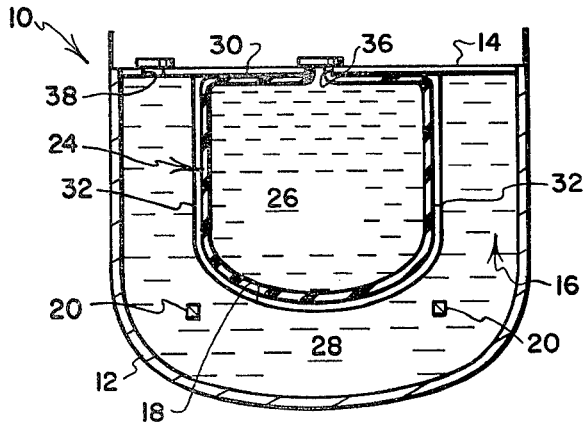
FIG. 2 is a sectional view of the ship and liner of FIG. 1 with the liner installed in a hold of the ship and filled with a first quantity of liquid, and with a second quantity of liquid filling hold spaces external to the liner; and, FIG. 3 is a sectional view similar to FIG. 2 with the liner emptied and collapsed within the hold, and with a single quantity of liquid filling hold portions which are external to the liner.

Referring to FIGS. 1 and 2, a feature of the invention relates to the provision of a liner 24 for insertion into the hold 16 to occupy the hold's unobstructed central region when the liner 24 is filled with a first quantity of liquid. The liner 24 is preferably formed from a durable, non-permeable multi-layered, flexible material such as plastic films sold by E. I. DuPont de Nemours & Company under the trademarks MYLAR (a polyester film) and SURLYN (an ionomer film); however, the liner 24 can be formed from any suitably durable, non-permeable, natural or synthetic material which is not caused to deteriorate in the presence of the liquid to be transported and which does not release undesirable chemicals into the liquid to be transported.

Referring to FIG. 2, the liner 24 functions (1) to define an inner chamber 26 located centrally within the hold 16, and (2) cooperates with walls of the hold 16 to define an outer chamber 28 which at least partially surrounds the inner chamber 26. In the embodiment illustrated in FIG. 2, the liner 24 has a top surface portion 30 which extends closely alongside the bottom surface of the deck structure 14, and sidewall surface portions 32, which are spaced inwardly from the plate and bracing members 18, 20.

Figure 3:
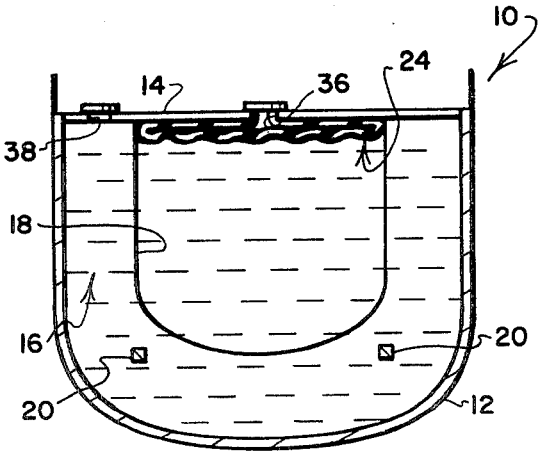

Filler openings 36, 38 are formed through the deck structure 14 for communicating with the inner and outer chambers 26, 28, respectively. If only one liquid is to be carried in the hold 16, the filler opening 38 is used to load such liquid into the outer chamber 28, and the liner 24 is permitted to collapse to a position lying closely along the underside of the deck structure 14, as is illustrated in FIG. 3. Such is the technique used when oil is to be transported in the hold 16, as when the tanker 10 is used to transport oil from an oil-producing country to an oil-consuming country.

When two quantities of liquid are to be transported in the hold 16, both filler openings 36, 38 are used to load such liquids into the chambers 26, 28. Loading is preferably begun by filling the outer chamber 28 to the level of the bottom of the liner 24, whereafter the liquids are loaded simultaneously into the chambers 26, 28 to maintain substantially equal liquid levels in the chambers 26, 28 to minimize stressing of the liner 24. If potable water is one of the liquids to be transported, it is loaded into the inner chamber 26 through the filler opening 36, and a separate quantity of liquid is loaded through the filler opening 38 into the outer chamber 28.

In preferred practice, the liquids loaded into the chambers 26, 28 have substantially the same specific gravities so that neither of the quantities of liquids tends to rise above the level of the other, whereby stressing of the liner 24 is minimized.

When two liquids are to be unloaded from the chambers 26, 28, they are preferably pumped out through the openings 36, 38 simultaneously so that their levels within the chambers 26, 28 remain substantially equal. Simultaneous pumping is continued until such time as the liner 24 is emptied, whereafter the remainder of the liquid in the outer chamber 28 is emptied. This technique minimizes stressing of the liner 24.

If desired, the liner 24 can be removed from the hold 16 and stored when only a single quantity of liquid such as oil is to be transported in the hold 16. In preferred practice, however, the liner 24 is formed from a sufficiently durable and flexible material to enable it to collapse, as shown in FIG. 3, while occupying a minimum of space within the hold 16, whereby the need to periodically remove the liner 24 from the hold 16, store the liner 24, and reinstall the liner 24 into the hold 16 is eliminated.

As will be apparent from the foregoing description, the system of the present invention provides both methods and apparatus for transporting potable water and other liquids in a common vessel. The system of the invention has significant utility in its provision of a relatively simple and inexpensive means which can be used to transport potable water in holds of oil tankers, and in its tendency to reduce pollution of the seas by eliminating the need to utilize salt water ballast which is later discharged in a polluted state.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of transporting first and second distinct quantities of liquid in a ship having a hull compartment therein of substantial size, said compartment having portions thereof defining an unobstructed volumetric area of generally unimpeded height, length and width parameters, and the remainder thereof defining an obstructed area including diverse spaced hull bracing, as plates, beams and related structural members of said ship and thereby having essentially no unimpeded volumetric dimension parameters of any substantial size, comprising the steps of:

(a) providing bag-like, highly flexible and collapsible, non-permeable liner means for defining a first liquid-fillable chamber within said unobstructed portions of the ship, and for cooperating with the walls of the hull compartment to define a second liquid-fillable chamber within such at least partially obstructed portions of the compartment as are not occupied by the liner means and the said first chamber;

(b) loading a first quantity of liquid into the liner means defining the first chamber, and loading a second quantity of liquid into the second chamber, with these loadings being conducted in a manner such that the first and second liquid quantities substantially fill the hull compartment when the loadings have been completed, whereby the ship will not become unstable due to shifting of the liquids;

(c) regulating said loadings so that flows of said first and second liquids maintain substantially equal levels of liquids within the first and second chambers on the inside and outside of said liner means thereby to avoid substantially unbalanced liquid pressure stresses on said flexible and collapsible liner means;

(d) at a time after the first and second quantities of liquid have been loaded, moving the ship to transport the first and second liquid quantities with the liner means maintaining segregation between the first and second liquid quantities;

(e) the said step of providing the ship with said flexible and collapsible liner means including the step of providing the liner means with at least portions thereof which are sufficiently flexible to enable the liner means to collapse within the compartment to occupy a minimum of space therein when it is desired to maximally fill the second chamber with liquid; and, (f) the said step of loading the first and second quantities being implemented at least in part, by providing the said flexible and collapsible liner means with flexible portions which deflect as need be during filling such that, as the first and second liquid quantities are loaded, the configuration of the liner means along its walls freely changes as may be required in response to forces acting on the first and second liquid quantities to assist in maintaining the substantially constant liquid levels in the first and second chambers to prevent unwanted liner means stress.

2. The method of claim 1 wherein the steps of loading first and second quantities of liquid includes the further step of selecting liquids to comprise the first and second quantities which have substantially the same specific quantities.

3. The method of claim 2 wherein the liquid loaded into the first chamber is fresh water having a specific gravity substantially the same as potable water.

4. The method of claim 1 wherein said liner means is formed from polymeric film.

5. The method of claim 1 including the further step of:

(a) after said moving of the ship, unloading the first and second quantities of liquid from the first and second chambers.

6. The method of claim 1 including the further step of unloading a third liquid present in said hull compartment therefrom prior to performing the said step of providing the liner means therein.

7. The method of claim 1 including the step of unloading a third liquid present in said hull compartment therefrom prior to said step of loading said first and second liquid quantities.

* * * * *